US006360401B1

(12) United States Patent
Salice

(10) Patent No.: US 6,360,401 B1
(45) Date of Patent: Mar. 26, 2002

(54) HINGE

(75) Inventor: Luciano Salice, Carimate (IT)

(73) Assignee: Arturo Salice S.p.A., Novedrato/Como (IT)

( * ) Notice: Subject to any disclaimer, the term of this patent is extended or adjusted under 35 U.S.C. 154(b) by 0 days.

(21) Appl. No.: 09/397,778

(22) Filed: Sep. 16, 1999

(30) Foreign Application Priority Data

Sep. 17, 1998 (DE) ..... 298 16 727

(51) Int. Cl.[7] ..... E05F 1/08
(52) U.S. Cl. ..... 16/335; 16/284
(58) Field of Search ..... 16/335, 297, 300, 16/277, 303, 284

(56) References Cited

U.S. PATENT DOCUMENTS

| | | | | | |
|---|---|---|---|---|---|
| 4,596,062 | A | * | 6/1986 | Rock | 16/304 |
| 4,716,622 | A | * | 1/1988 | DeBruyn | 16/297 |
| 5,027,474 | A | | 7/1991 | Bowers | |
| 5,355,557 | A | * | 10/1994 | Cress et al. | 16/286 |
| 5,524,323 | A | | 6/1996 | Lin | |
| 5,546,633 | A | | 8/1996 | Liu | |
| 5,604,956 | A | * | 2/1997 | Grass | 16/278 |
| 5,617,612 | A | * | 4/1997 | Ferrari et al. | 16/278 |
| 5,655,261 | A | * | 8/1997 | Cress | 16/286 |
| 6,049,946 | A | * | 4/2000 | Cress et al. | 16/240 |

FOREIGN PATENT DOCUMENTS

| | | |
|---|---|---|
| DE | 2460127 | 6/1976 |
| DE | 2658514 | 6/1978 |
| DE | 3601682 | 7/1987 |
| DE | 3840245 | 5/1990 |
| DE | 9314375 | 2/1994 |
| EP | 0790379 | 8/1997 |
| FR | 2086843 | 12/1971 |
| HU | 159645 | 6/1971 |
| HU | 205191 | 11/1991 |

* cited by examiner

*Primary Examiner*—Anthony Knight
*Assistant Examiner*—Mark Williams
(74) *Attorney, Agent, or Firm*—Dilworth & Barrese, LLP

(57) ABSTRACT

The present invention is directed to a hinge in which a fixed end of a leaf spring is inserted into a slot of a side wall of a cup-shaped hinge part near the bottom, the leaf spring encompassing with an opening, a cam or a protruding of the bottom of the cup-shaped hinge part. The hinge arm is slidably supported on a elastic end of the leaf spring by a tongue or cam bent out of its rolled end and encompassing the hinge axle, the elastic end located in a section of the bottom of the cup-shaped hinge part.

11 Claims, 3 Drawing Sheets

HINGE

BACKGROUND OF THE INVENTION

The invention relates to a hinge, preferably a furniture hinge, comprising a hinge arm pivoted on a hinge axle mounted unmoveably on a cup-shaped, swivellable hinge part and provided with a tongue extending over the hinge axle or a cam eccentric to the hinge axle or a metering notch which slide on a leaf spring mounted with one end region on the swivellable hinge part and creating a closing moment in the closing region.

In a hinge of a similar type known from U.S. Pat. No. 5,027,474, the cup-shaped hinge part is provided on its side opposite the open side with a bridge on which a leaf spring is supported which is supported on its rear end on a bar formed onto the hinge part and which applies pressure with its front end to a cam disposed on the hinge arm in the region of the hinge axle bearing it. In the cup-shaped hinge part, two slots tapering towards the bottom are provided in which the hinge axle is movably guided and held by the leaf spring. This known hinge is relatively complex because the cup-shaped hinge part is provided with a specially formed bar and with a retaining apparatus for the leaf spring.

A hinge of the type first given known from DE 36 01 682 A1 possesses a leaf spring whose bent-down end is held in a slot of the bottom of the cup-shaped hinge part and whose middle part is supported against a journal which extends laterally into the hinge cup and is fixed on a side wall of this. This type of fixation of the leaf spring is also complex and only allows the elastic end of the leaf spring from the opening side of the hinge cup to act on a metering notch of the hinge arm whose rolled end is supported on the hinge axle.

SUMMARY OF THE INVENTION

It is the object of the invention to provide a hinge of the type first given on whose cup-shaped hinge part the leaf spring generating the closing moment can be fixed in a simple manner thus allowing economic production.

This object is solved in accordance with the invention by the fixated end of the leaf spring being inserted in a slot of the side wall of the cup-shaped hinge part near the bottom and by the leaf spring encompassing with an opening a cam or a protrusion of the bottom of the cup-shaped hinge part and by the hinge arm being slidably supported on the elastic end of the leaf spring by a tongue or cam bent out of its rolled end encompassing the hinge axle, said elastic end being located in a section of the bottom of the cup-shaped hinge part.

In the hinge in accordance with the invention, the leaf spring can be mounted easily to the hinge cup by the side wall of said hinge cup being provided in the region of the bottom with an incision or a tongue-like section from which then a retaining tongue is bent inwards so that the end of the leaf spring can be fixed in the slot or under the inwardly bent tongue. The fixed end of the leaf spring is appropriately cut in such a way that the side edges of the end piece abut the side edges of the incision or the section for the tongue. Any axial movement of the leaf spring is prevented by this encompassing with an opening a protrusion or a cam-like elevation in the bottom of the hinge cup which can be formed, for example, by embossing when the hinge cup comprises a stamped metal part. To provide the elastic end of the leaf spring with the required spring deflection, the bottom of the hinge cup is provided with a corresponding section.

In accordance with another embodiment, the object in question is solved by the retained end of the leaf spring gripping below a tongue bent out of the bottom of the cup-shaped hinge and being supported with a shoulder formed by a bending at an angle on the edge of the bottom formed by the cut-out of the tongue. In this embodiment, the leaf spring is fixated under the bent-out tongue and at the edges forming the tongue section so that no additional holding of the leaf spring is required. In this embodiment, too, the hinge arm is slidingly supported on the elastic end of the leaf spring by a tongue or cam bent out of its rolled end encompassing the hinge axle which is located in a section of the bottom of the cup-shaped hinge part to allow the required spring deflection.

In accordance with a third embodiment, the object in question is solved in accordance with the invention by the leaf spring being formed by a tongue-like cut-out of the bottom of the cup-shaped hinge part. In this embodiment, the hinge cup appropriately comprises a stamped metal part which is subsequently hardened at least in the bottom region in such a way that the cut-out leaf spring is given the required elastic properties.

In accordance with a preferred embodiment, it is provided that the leaf spring is provided on its elastic end region with an arched curvature which is adapted to the cam or the tongue in such a way that the force exerted thereon in the opening region runs roughly through the hinge axle and only acts on a lever arm generating a closing moment in the closing region.

To effect an adjustment of the hinge even after assembly, the hinge arm is appropriately mounted movably on a retaining arm via a self-retaining eccentric regulation. A further adjustment in the depth of the furniture is possible if the retaining arm itself is held movably on a base plate via a self-retaining eccentric regulation.

BRIEF DESCRIPTION OF THE DRAWINGS

Embodiments of the invention are described in more detail below by means of the drawing in which.

DESCRIPTION OF THE PREFERRED EMBODIMENTS

Figure 1:
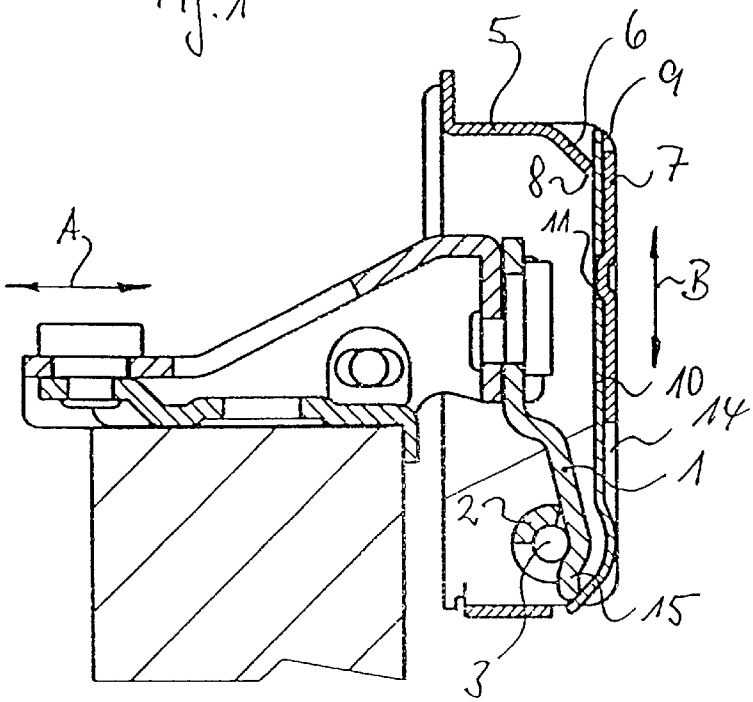
FIG. 1 shows a longitudinal section through a hinge with a retaining plate and a base plate in the closed state.
Figure 2:
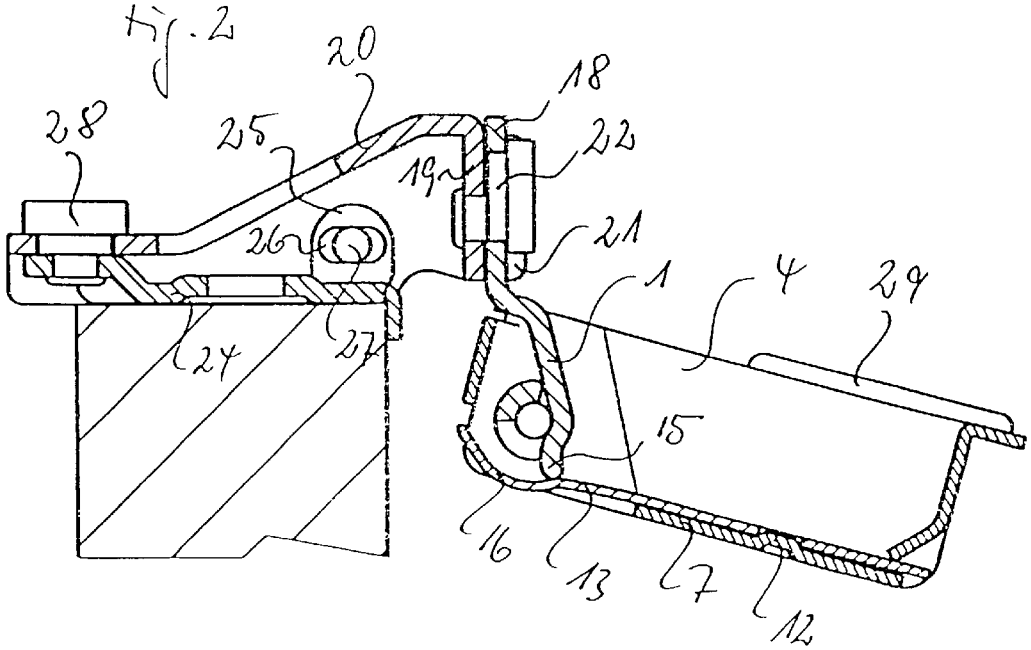
FIG. 2 shows the hinge of FIG. 1 in the opened state.

The hinge in FIGS. 1 and 2 comprises a hinge arm 1 provided with a bending at an angle which hinge arm 1 encompasses with its lower rolled end 2 a hinge axle 3 which end 2 equally forms a bearing borehole therefor. The hinge axle 3 is supported unmoveably in the conventional manner in the side walls of the cup-shaped hinge part 4. On the end of the hinge part 4 opposite the hinge axle 3, the side wall 5 of the hinge part 4 is provided with a tongue-like section and a tongue 6 is bent therefrom into the inside of the hinge part 4. Between the lower edge of the tongue 6 and the bottom 7 of the hinge part 4, a slot 8 is formed in which the rear end 9 of a leaf spring 10 is inserted. The rear end 9 of the leaf spring 10 is provided with a smaller width so that the rear end 9 abuts the side edges of the tongue section with its side edges. At a distance from the slot 8, the leaf spring 10 is provided with a round hole 11 which encompasses a knub 12 embossed in the bottom 7. In this way, the leaf spring 10 is held unrotatably and—in an axial direction—unmoveably with its part lying on the bottom 7. The front end 13 of the leaf spring 10 is located in a cut-out 14 of the bottom 7 so that it can come to rest in the required manner.

A tongue 15 equally forming a lever arm is bent out of the rolled part 2 of the hinge arm 1. The front elastic end of the leaf spring 10 is provided with a curvature 16 which is formed concentrically to the hinge axle 3 in the opening region of the hinge part 4 and which possesses in its end region a flattening so that the leaf spring 10 exerts a closing moment in the manner seen from FIG. 1 on the bent-out tongue 15 in the closing region.

The hinge arm 1 is guided with its rear end 18 on the front side 19 of a retaining arm 20 in a longitudinally movable manner with the front side 19 being provided with raised side edges 21 for a non-twist guide. The hinge arm 1 is connected to the front side 19 of the retaining arm by an eccentric 22 so that the hinge arm 1 can be moved relative to the front side 19 of the retaining arm 20 in the direction of the arrow B for lateral adjustment by means of the eccentric 22, for example using a screwdriver.

The retaining arm 20 is guided in a longitudinally movable manner on a base plate 24, with the base plate being provided on its front end with laterally bent-down side walls 25 which possess oblong holes 26 in which a pin 27 mounted in the side legs of the retaining arm 20 is guided. The rear end of the retaining arm 20 is connected to the base plate 24 by an eccentric regulation 28 so that by turning the eccentric regulation 28, the hinge can be adjusted in its depth in the direction of arrow A.

The cup-shaped hinge part 5 is inserted in a conventional manner into a flat, blind borehole, for example of a door and connected thereto by a flange 29 which is part of the cup-shaped hinge part.

Figure 3:
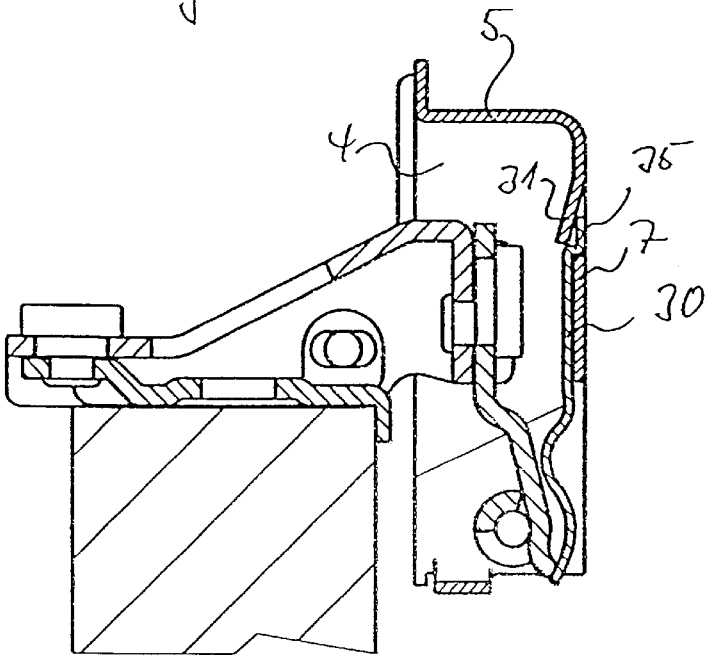
FIG. 3 shows a longitudinal section through a second embodiment of a hinge with a retaining arm and a base plate in the closed state.
Figure 4:
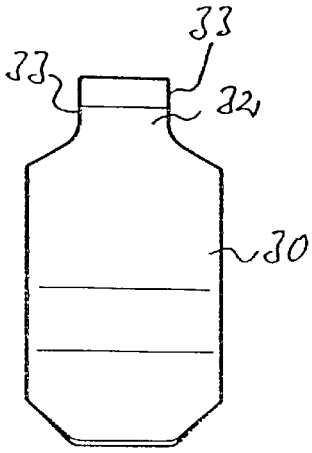
FIG. 4 shows a top view of the leaf spring of the hinge of FIG. 3.
Figure 5:
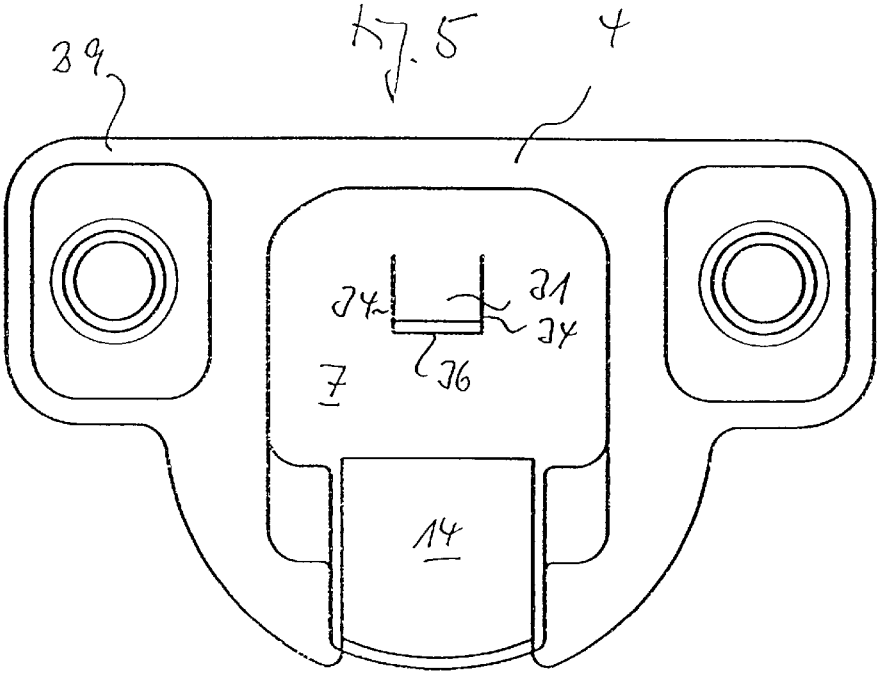
FIG. 5 shows a top view of the cup-shaped hinge part of FIG. 3.

Another embodiment of the hinge can be seen from FIGS. 3 to 5, which differs from the hinge of FIGS. 1 and 2 only in the type of formation and retention of the leaf spring 30. From the bottom 7 of the cup-shaped hinge part 4, a tongue 31 has been bent out by a corresponding cut-out. The leaf spring 30 is provided with a rear part 32 bent at an angle with a smaller width. The rear narrower part 32 of the leaf spring 30 abuts the side edges 34 of the cut-out with its side edges 33. The shoulder formed by the bending at an angle abuts the front edge 36 of the cut-out in the manner visible from FIG. 3 so that the leaf spring is held unrotatably between the tongue 31 and the front side edge of the cut-out 36 in the manner visible from the drawing and unmoveably in the longitudinal direction. To improve the elastic properties, the front elastic end of the leaf spring 30 has an S-shaped curve. The front curved region is curved in the same way as the front region 16 of the leaf spring 10 of FIGS. 1 and 2 in order to obtain the desired closing characteristics.

Figure 6:
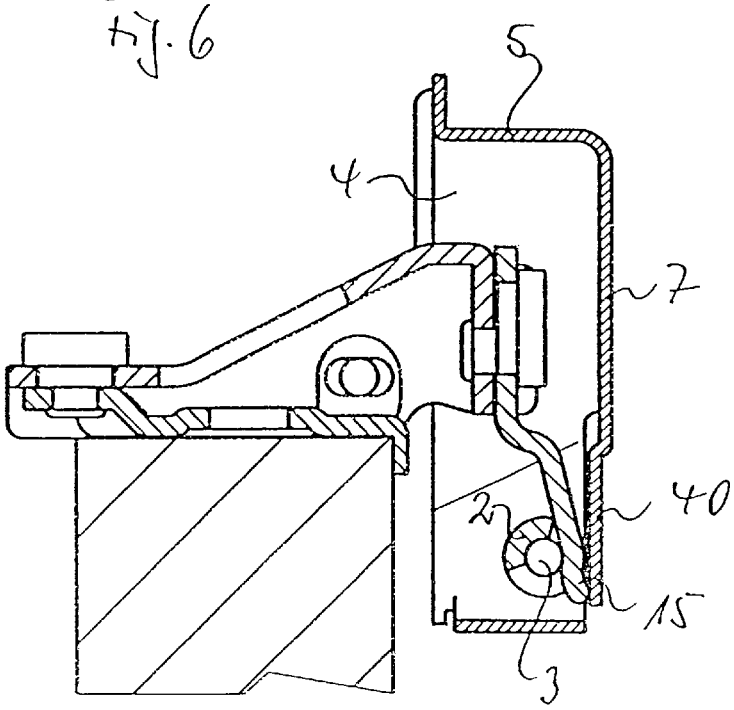
FIG. 6 shows a section through a third embodiment of a hinge with a retaining arm and a base plate in the closed state.
Figure 7:
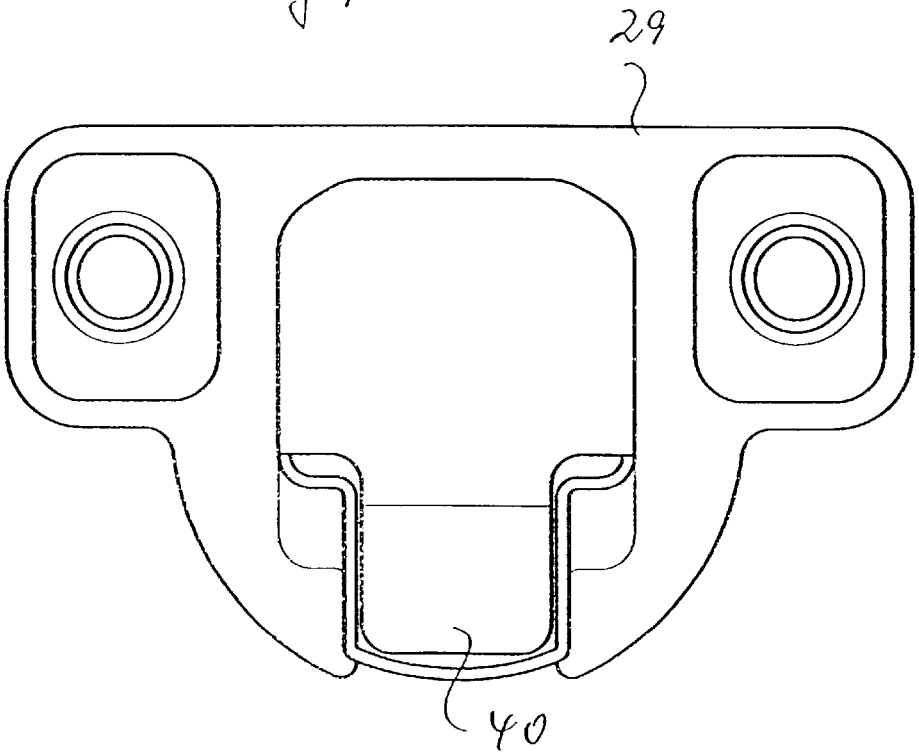
FIG. 7 shows a top view of the cup-shaped hinge part of FIG. 6.

The third embodiment of the hinge visible from FIGS. 6 and 7 differs from that of FIGS. 1 and 2 in that the leaf spring 40 is cut out of the bottom 7 of the cup-shaped hinge part 5 in the manner shown. The cup-shaped hinge part 5 comprises a stamped metal part whose material can be hardened in such a way that the cut-out tongue 40 is provided with the required elastic properties.

What is claimed is:

1. A hinge, comprising
- a hinge arm (1),
- a hinge axle (3) upon which said hinge arm (1) is pivotally mounted,
- a cup-shaped, swivellable hinge part (4) upon which said hinge axle (3) is retained,
- said hinge arm (1) comprising a tongue (15) extending over the hinge axle (3),
- a leaf spring (10) supported (5) with one end region on the swivellable hinge part (4) and creating a closing moment in a closing region, with the tongue (15) arranged to slide on the leaf spring (10), wherein
  - a fixed end (9) of the leaf spring (10) is inserted in a slot (8) of a side wall (5) of the cup-shaped hinge part (4) near a bottom (7) of the cup-shaped hinge part (4),
  - the leaf spring (10) encompasses with an opening (11), a knub (12) or protrusion mounted upon the bottom (7) of the cup-shaped hinge part (4),
  - the hinge arm (1) is slidingly supported on an elastic end (13) of the leaf spring (10) by the tongue (15) bent out of a rolled end (2) of the hinge arm (1) encompassing the hinge axle (3),
  - which elastic end (13) of the leaf spring (10) is located in a section or cut-out (14) of the bottom (7) of the cup-shaped hinge part (4).

2. A hinge in accordance with claim 1, wherein the leaf spring is provided on its elastic end region with an arched curvature (16) which is adapted to the tongue (15) or the cam in such a way that the force exerted thereon in the opening region runs roughly through the hinge axle (3) and only acts on a lever arm generating a closing moment in the closing region.

3. A hinge in accordance with claim 2, wherein the hinge arm (1) is moveably held on a retaining arm (20) via a self-retaining eccentric regulation (22).

4. A hinge in accordance with claim 2, wherein a retaining arm (20) on which the hinge arm (1) is movably held, is movably guided on a base plate (24) and can be adjusted in the longitudinal direction by a self-retaining eccentric regulation (28).

5. A hinge in accordance with claim 1, wherein the hinge arm (1) is movably held on a retaining arm (20) via a self-retaining eccentric regulation (22).

6. A hinge in accordance with claim 5, wherein the retaining arm (20) is moveably guided on a base plate (24) and can be adjusted in the longitudinal direction by a self-retaining eccentric regulation (28).

7. A hinge in accordance with claim 1, wherein a retaining arm (20) upon which the hinge arm (1) is movably held, is movably guided on a base plate (24) and can be adjusted in the longitudinal direction by a self-retaining eccentric regulation (28).

8. A hinge comprising
- a hinge arm (1),
- a hinge axle (3) upon which said hinge arm (1) is pivotally mounted,
- a cup-shaped, swivellable hinge part (4) upon which said hinge axle (3) is retained,
- said hinge arm (1) comprising a tongue (15) extending over the hinge axle (3),
- a leaf spring (30) supported (5) with one end region on the swivellable hinge part (4) and creating a closing moment in a closing region, with the tongue (15) arranged to slide on the leaf spring (10), wherein a fixed end (32) of the leaf spring (30) engages under a tongue (31) bent out of the bottom (7) of the cup-shaped hinge part (4), the fixed end (32) is supported on an edge (36) of the bottom (7) formed by the cut-out of the tongue (31) by a shoulder of the leaf spring (30) formed by bending the leaf spring (30) at an angle (35), and the hinge arm (1) is slidingly supported on an elastic end (13) of the leaf spring (30) by the tongue (15) bent out of a rolled end (2) of the hinge arm (1) encompassing the hinge axle (3), which elastic end (13) of the leaf spring (10) is located in a section or cut-out (14) of the bottom (7) of the cup-shaped hinge part (4).

9. A hinge comprising a hinge arm (1), a hinge axle (3) upon which said hinge arm (1) is pivotally mounted, a cup-shaped, swivellable hinge part (4) upon which said hinge axle (3) is retained, said hinge arm (1) comprising a tongue (15) extending over the hinge axle (3), a leaf spring (40) supported (5) with one end region on the swivellable hinge part (4) and creating a closing moment in a closing region, with the tongue (15) arranged to slide on the leaf spring (40), wherein the leaf spring (40) is formed by a tongue-like cut-out of a bottom (7) of the cup-shaped hinge part (4) and the hinge arm (1) is slidingly supported on an elastic end of the leaf spring (40) by the tongue (15) bent out of a rolled end (2) of the hinge arm (1) encompassing the hinge axle (3).

10. A hinge comprising a hinge arm (1), a hinge axle (3) upon which said hinge arm (1) is pivotally mounted, a cup-shaped, swivellable hinge part (4) upon which said hinge axle (3) is retained, said hinge arm (1) comprising a tongue (15) extending over the hinge axle (3), a leaf spring (30) supported (5) with one end region on the swivellable hinge part (4) and creating a closing moment in a closing region, with the tongue (15) arranged to slide on the leaf spring (30), wherein a fixed end (32) of the leaf spring (30) engages under a tongue (31) bent out of the bottom (7) of the cup-shaped hinge part (4), the fixed end (32) is supported on an edge (36) of the bottom (7) formed by the cut-out of the tongue (31) by a shoulder of the leaf spring (30) formed by bending the leaf spring (30) at an angle (35), the hinge arm (1) is slidingly supported on an elastic end (13) of the leaf spring (30) by the tongue (15) bent out of a rolled end (2) of the hinge arm (1) encompassing the hinge axle (3), which elastic end (13) of the leaf spring (30) is located in a section or cut-out (14) of the bottom (7) of the cup-shaped hinge part (4), and comprising at least one of the following (a)–(c):

(a) the leaf spring is provided on its elastic end region with an arch curvature (6) which is adapted to the tongue (15) in such a way that the force exerted thereon in the opening region runs roughly through the hinge axle (3) and only acts on a lever arm generating a closing moment in the closing region, (b) the hinge arm (1) is movable held on a retaining arm (20) via a self-retaining eccentric regulation (22), and (c) a retaining arm (20) upon which the hinge arm (1) is movably held is moveably guided on a base plate (24) and can be adjusted in a longitudinal direction by a self-retaining eccentric regulation (28).

11. A hinge comprising a hinge arm (1), a hinge axle (3) upon which said hinge arm (1) is pivotally mounted, a cup-shaped, swivellable hinge part (4) upon which said hinge axle (3) is retained, said hinge arm (1) comprising a tongue (15) extending over the hinge axle (3), a leaf spring (40) supported (5) with one end region on the swivellable hinge part (4) and creating a closing moment in a closing region, with the tongue (15) arranged to slide on the leaf spring (40), wherein the leaf spring (40) is formed by a tongue-like cut-out of a bottom (7) of the cup-shaped hinge part (4) and the hinge arm (1) is slidingly supported on an elastic end of the leaf spring (40) by the tongue (15) bent out of a rolled end (2) of the hinge arm (1) encompassing the hinge axle (3), and comprising at least one of the following (a)–(c):

(a) the leaf spring (40) is provided on its elastic end region with an arch curvature (6) which is adapted to the tongue (15) in such a way that the force exerted thereon in the opening region runs roughly through the hinge axle (3) and only acts on a lever arm generating a closing moment in the closing region, (b) the hinge arm (1) is movable held on a retaining arm (20) via a self-retaining eccentric regulation (22), and (c) a retaining arm (20) upon which the hinge arm (1) is movably held, is moveably guided on a base plate (24) and can be adjusted in a longitudinal direction by a self-retaining eccentric regulation (28).

* * * * *